US008072384B2

(12) United States Patent
Morrow

(10) Patent No.: US 8,072,384 B2
(45) Date of Patent: Dec. 6, 2011

(54) DUAL-POLARIZED ANTENNA MODULES

(75) Inventor: Jarrett D. Morrow, Bow, NH (US)

(73) Assignee: Laird Technologies, Inc., Chesterfield, MO (US)

( * ) Notice: Subject to any disclaimer, the term of this patent is extended or adjusted under 35 U.S.C. 154(b) by 541 days.

(21) Appl. No.: 12/353,884

(22) Filed: Jan. 14, 2009

(65) Prior Publication Data

US 2010/0177012 A1 Jul. 15, 2010

(51) Int. Cl.
*H01Q 1/38* (2006.01)

(52) U.S. Cl. ..... 343/700 MS; 343/853; 343/846

(58) Field of Classification Search ..... 343/700 MS, 343/846, 848, 850, 853
See application file for complete search history.

(56) References Cited

U.S. PATENT DOCUMENTS

| | | | | |
|---|---|---|---|---|
| 4,929,959 | A | 5/1990 | Sorbello et al. | |
| 5,382,959 | A * | 1/1995 | Pett et al. | 343/700 MS |
| 5,995,047 | A * | 11/1999 | Freyssinier et al. | 343/700 MS |
| 6,067,053 | A | 5/2000 | Runyon et al. | |
| 6,885,342 | B2 | 4/2005 | Saegrov et al. | |
| 6,956,528 | B2 | 10/2005 | Lee et al. | |
| 6,982,672 | B2 * | 1/2006 | Lin et al. | 343/700 MS |
| 7,327,317 | B2 | 2/2008 | Heiniger | |
| 7,423,595 | B2 | 9/2008 | Säily | |

OTHER PUBLICATIONS

A Study of Wideband Dual-Frequency Dual-Polarization Microstrip Array Antenna, Yeunjeong Kim, Sewoong, Kwon, Eunsil Oh, Youngjoong Yoon, © 2000 IEEE, 4 pages.

Broadband Dual-Polarized Patch Antennas With Hybrid Feeds for 1800-Mhz Band Operation, Hong-Twu Chen, Tzung-Wern Chiou, Kin-Lu Wong, © 2001 IEEE, 4 pages.

Broad-Band Dual-Polarized Patch Antennas Fed by Capacitively Coupled Feed and Slot-Coupled Feed, Kin-Lu Wong, Tzung-Wern Chiou, © 2002 IEEE, 6 pages, IEEE Transactions on Antennas and Propagation, vol. 5, No. 3, Mar. 2002.

A Stamped Antenna for Tolling Application At 5.8GHz, F. Gallee, E. Goron, S. Chainon, L. Le Garrec, Y. Toutain, H. Lattard, Antennessa, Bât. Ponant, Avenue la Pérouse 29280 Plouzané, France, 5 pages.

* cited by examiner

*Primary Examiner* — Hoang V Nguyen
(74) *Attorney, Agent, or Firm* — Harness, Dickey & Pierce, P.L.C.

(57) ABSTRACT

An array antenna module includes multiple antenna assemblies. Each antenna assembly generally includes a first radiating element and a second radiating element spaced apart from the first radiating element and capacitively coupled thereto. A first transmission line is capacitively coupled to the first radiating element, and a second transmission line is electrically coupled to the first radiating element by a connector. The antenna assembly is operable to transmit at least one or more signals to at least one or more wireless application devices and/or to receive at least one or more signals from at least one or more wireless application devices. The first radiating element, second radiating element, first transmission line, and/or second transmission line are coupled to substrates. And at least one or more of the substrates may include epoxy resin bonded glass fabric such as, for example, flame retardant 4.

50 Claims, 7 Drawing Sheets

DUAL-POLARIZED ANTENNA MODULES

FIELD

The present disclosure relates generally to antenna modules, and more particularly to dual-polarized antenna modules, for example, for use with wireless application devices, etc.

BACKGROUND

This section provides background information related to the present disclosure which is not necessarily prior art.

Wireless application devices, such as laptop computers, cellular phones, wireless monitoring devices, etc. are commonly used in wireless operations. And such use is continuously increasing. Consequently, additional frequency bands are required (at lowered costs) to accommodate the increased use, and antenna assemblies capable of handling the additional different frequency bands are desired.

SUMMARY

This section provides a general summary of the disclosure, and is not a comprehensive disclosure of its full scope or all of its features.

Example embodiments of the present disclosure are generally directed toward antenna assemblies configured for use with at least one or more wireless application devices. In one example embodiment, an antenna assembly generally includes a first radiating element and a second radiating element spaced apart from the first radiating element and capacitively coupled thereto. A first transmission line is capacitively coupled to the first radiating element, and a second transmission line is electrically coupled to the first radiating element by a connector. The antenna assembly is operable to transmit at least one or more signals to at least one or more wireless application devices and/or to receive at least one or more signals from at least one or more wireless application devices.

Example embodiments of the present disclosure are also generally directed toward array antenna modules. In one example embodiment, an array antenna module generally includes an array of antenna assemblies. Each antenna assembly generally includes a first radiating element, a second radiating element spaced apart from the first radiating element and capacitively coupled to the first radiating element, a first transmission line capacitively coupled to the first radiating element, a second transmission line, and a connector electrically coupling the second transmission line and the first radiating element.

In another example embodiment, an array antenna module generally includes first, second, and third spaced apart substrates. The first, second, and third substrates are positioned in a generally stacked orientation such that the second substrate is disposed generally between the first and third substrates. At least one or more of the first, second, and third substrates includes epoxy resin bonded glass fabric. The example array antenna module also includes multiple first and second pairs of radiating elements. A first radiating element of each pair is coupled to the second substrate and a second radiating element of each pair is coupled to the first substrate in a stacked orientation relative to the first radiating element of its pair. First and second transmission line networks are provided for interconnecting each of the multiple first and second pairs of radiating elements and for use in feeding at least one or more signals to the multiple first and second pairs of radiating elements. The first transmission line network is operable for feeding the at least one or more signals to the multiple first and second pairs of radiating elements at a first polarization, and the second transmission line network is operable for feeding the at least one or more signals to the multiple first and second pairs of radiating elements at a second polarization.

In another example embodiment, an array antenna module generally includes first, second, and third spaced apart printed circuit boards positioned in a generally stacked orientation such that the second printed circuit board is disposed generally between the first and third printed circuit boards. At least one or more of the first, second, and third printed circuit boards includes flame retardant 4. The example array antenna module also generally includes multiple pairs of driven and parasitic patches. A driven patch of each pair is etched on an upper surface of the second printed circuit board, and a parasitic patch of each pair is etched on an upper surface of the first printed circuit board in a stacked orientation relative to its paired driven patch. First and second transmission line networks are provided for interconnecting each of the multiple pairs of driven and parasitic patches and for feeding at least one or more signals to the multiple pairs of driven and parasitic patches for transmission to at least one or more wireless application devices. The first transmission line network is etched on a lower surface of the second printed circuit board and the second transmission line network is etched on a lower surface of the third printed circuit board. Further, the first transmission line network is capacitively coupled to each pair of driven and parasitic patches. Multiple electrical connectors connect the second transmission line network to each driven patch of each pair of driven and parasitic patches. The first transmission line network is operable for feeding the at least one or more signals to the multiple pairs of driven and parasitic patches at a first polarization, and the second transmission line network is operable for feeding the at least one or more signals to the multiple pairs of driven and parasitic patches at a second polarization.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
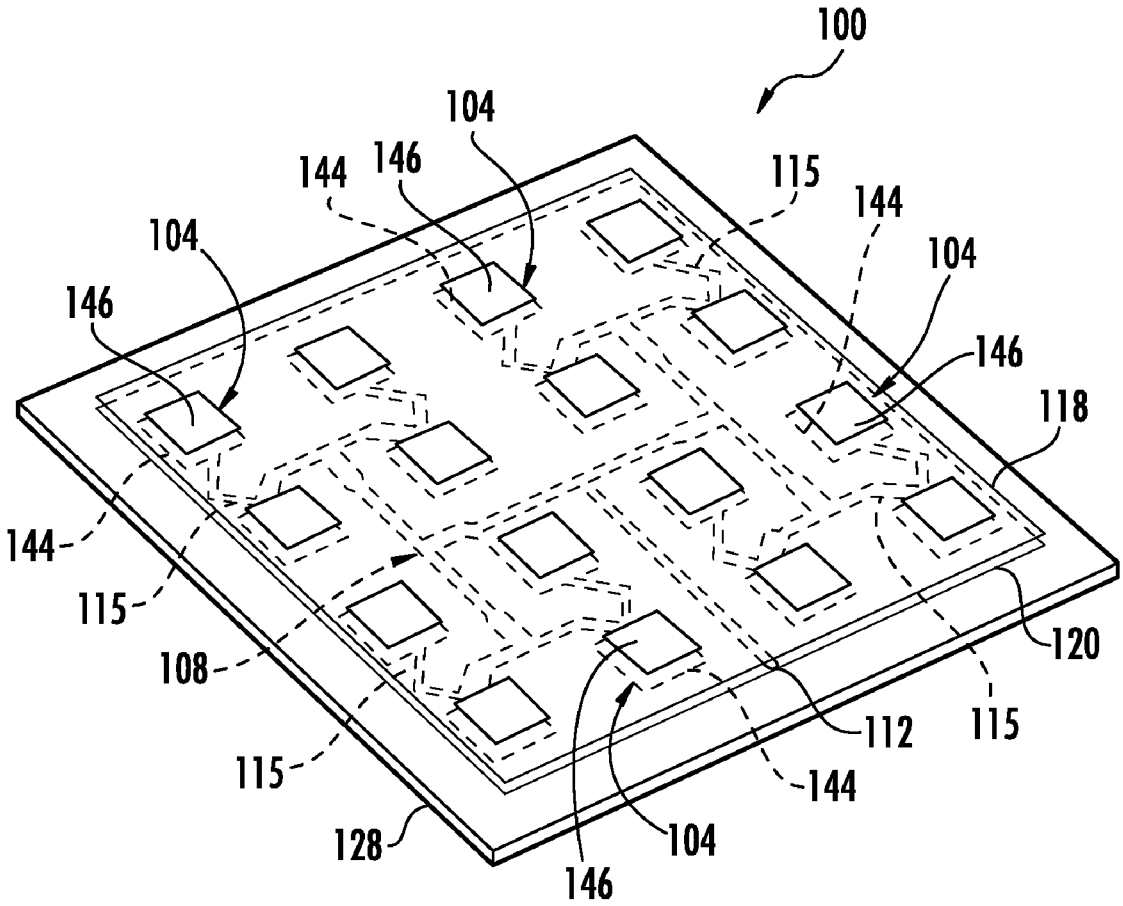
FIG. 1 is an upper perspective view of an example embodiment of an array antenna module including one or more aspects of the present disclosure.
Figure 7:
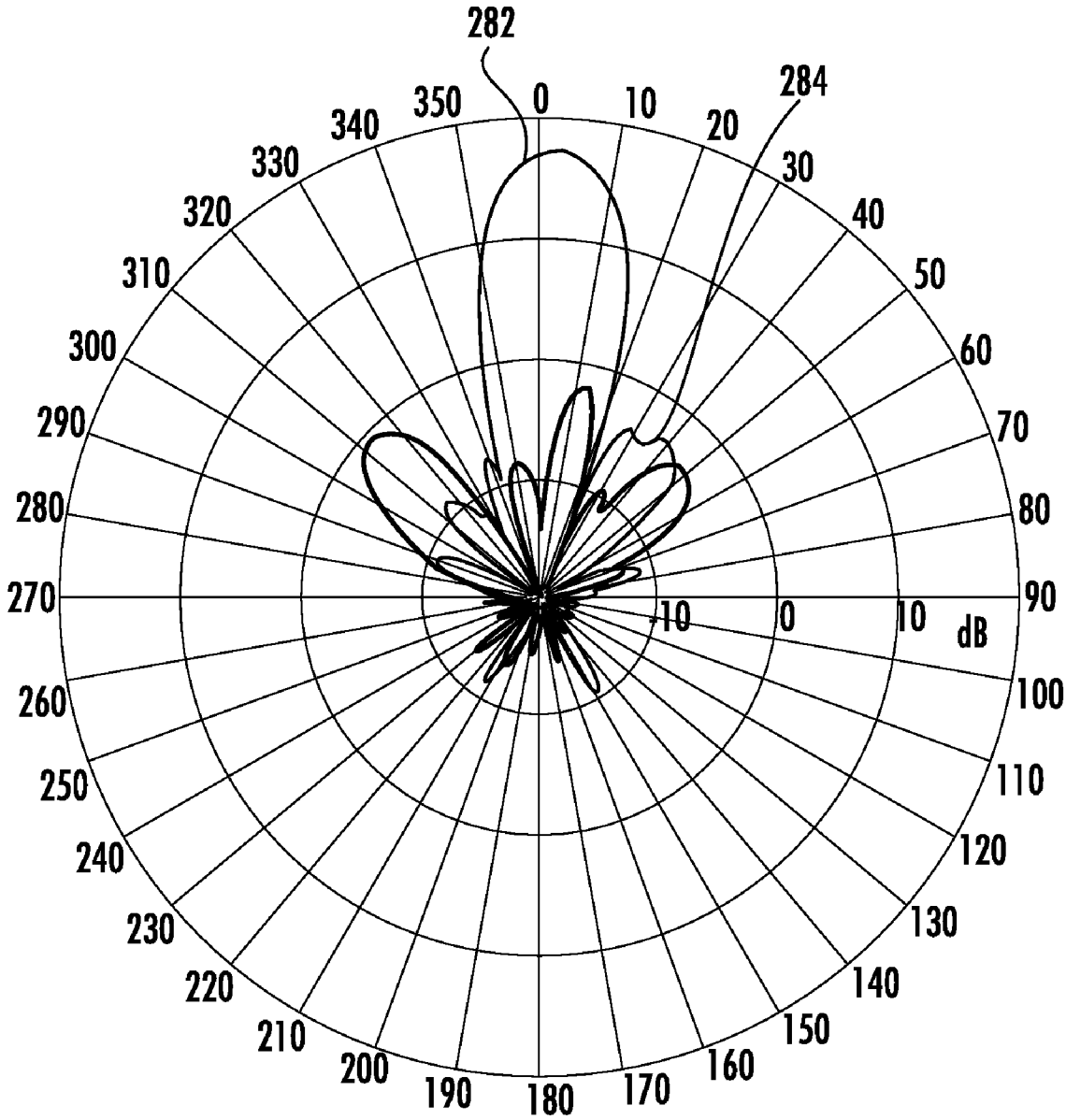
Figure 8:
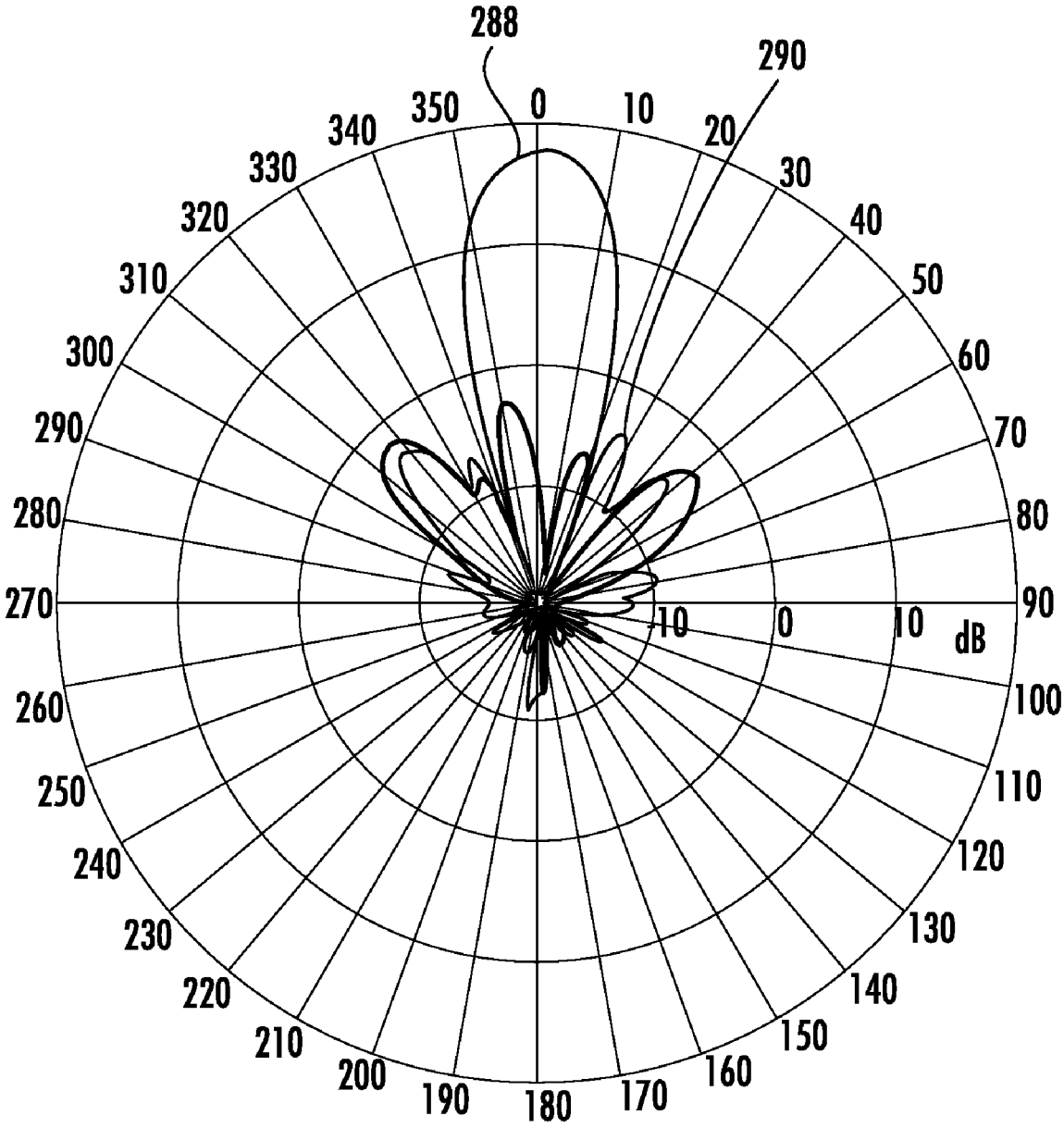

FIG. 7 illustrates co-polar and cross-polar E-plane (elevation) radiation patterns for the example array antenna module of FIG. 1 measured at a second port of the array antenna module at a frequency of about 5.47 GHz; and FIG. 8 illustrates co-polar and cross-polar H-plane (azimuth) radiation patterns for the example array antenna module of FIG. 1 measured at the second port of the array antenna module at a frequency of about 5.47 GHz.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and/or methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

According to various aspects of the present disclosure, array antenna modules (and antenna assemblies suitable for use with array antenna modules) are provided suitable for operation over multiple different frequency bandwidths. For example, the array antenna modules may be suitable for operation over frequency bandwidths including, for example, GSM 850, GSM 900, GSM 1800, GSM 1900, UMTS 2100, Wi-Fi 2400, Wi-Fi 5000, etc. In addition, the array antenna modules may be used, for example, in systems and/or networks and/or devices such as those associated with cellular systems, wireless internet service provider (WISP) networks, broadband wireless access (BWA) systems, wireless local area networks (WLANs), wireless application devices, etc.

Array antenna modules of the present disclosure may also receive and/or transmit one or more signals from and/or to systems, networks, and/or devices. For example, antenna assemblies of the array antenna modules can include dual-polarized antenna assemblies that can enable substantially simultaneous transmission and/or reception of at least two or more independent signals. Moreover, the dual-polarized antenna assemblies can also enable operation of multiple-input multiple-output (MIMO) systems, where multiple signals are transmitted and received at both ends of the link, and signal processing encodes and decodes the actual data.

With reference now to the drawings, FIGS. 1-4 illustrate an example embodiment of an array antenna module 100 (or array antenna panel, or antenna panel, or antenna, etc.) including one or more aspects of the present disclosure. As an example, the illustrated array antenna module 100 may be configured for use with wireless application devices (e.g., a Personal Digital assistant, a personal computer, a cellular phone, etc.) for transmitting signals to the wireless application devices and/or for receiving signals from the wireless application devices. The illustrated array antenna module 100 may be included as part of radio housing hardware for use in communicating with a base station subsystem of a cellular telephone network operable for helping to handle traffic and signaling between cellular phones and network switching subsystems. Alternatively, the illustrated array antenna module 100 may be included as part of the base station subsystem itself, or as part of a point-to-point data backhaul system, or as part of other systems, networks, devices, etc. within the scope of the present disclosure.

Figure 2:
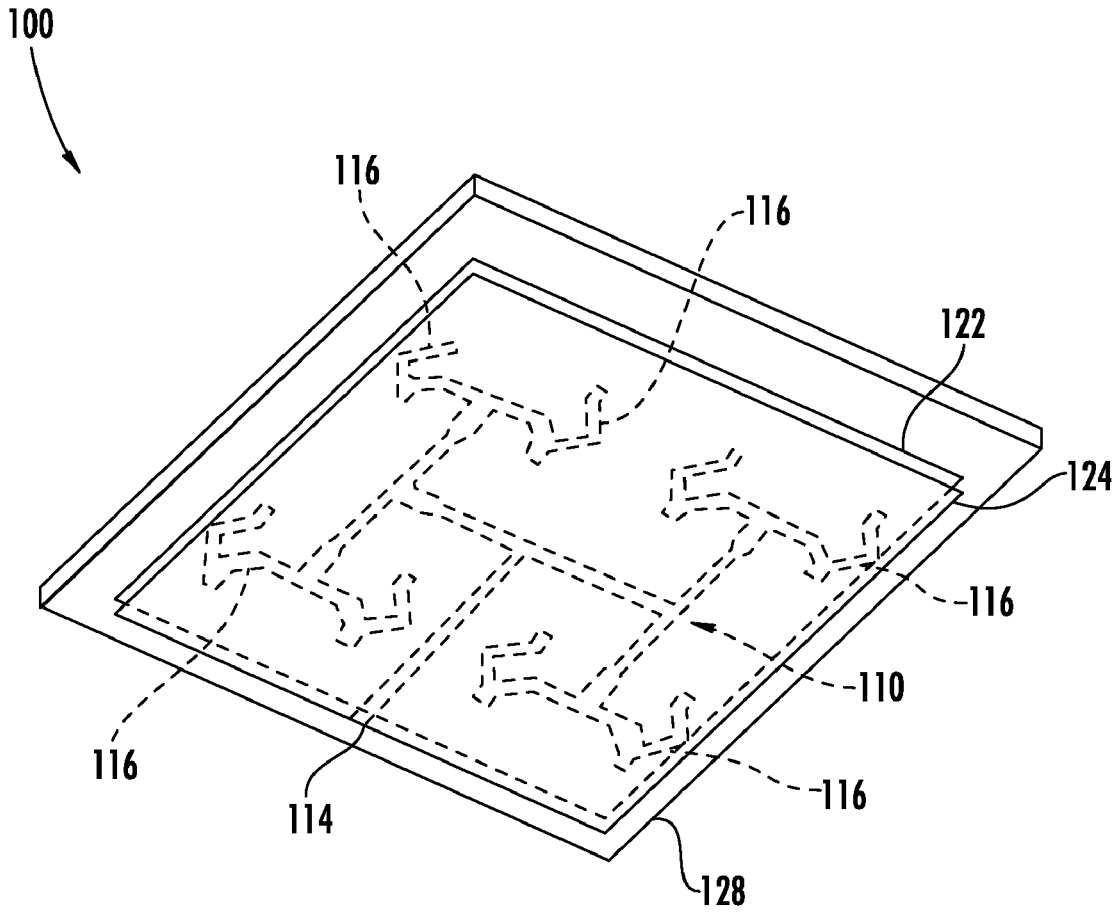
FIG. 2 is a lower perspective view of the array antenna module of FIG. 1.

As shown in FIGS. 1 and 2, the illustrated array antenna module 100 generally includes an array of antenna assemblies 104 disposed across the module 100. The illustrated array antenna module 100 includes sixteen antenna assemblies 104 generally oriented in a four-by-four array. And first and second feed networks 108 and 110 (or transmission line networks, etc.) interconnect the antenna assemblies 104 for operation (e.g., for providing signals to and/or for receiving signals from the antenna assemblies 104, etc.). The first feed network 108 is shown in FIG. 1 extending generally along an upper portion of the array antenna module 100. The first feed network 108 includes a first port 112. And the second feed network 110 is shown in FIG. 2 extending generally along a lower portion of the array antenna module 100. The second feed network 110 includes a second port 114.

The first feed network 108 and the second feed network 110 are each positioned within generally parallel planes. And in the illustrated embodiment each defines a substantially similar network pattern. The network pattern of the second feed network 110 (FIG. 2), however, is angularly offset from the network pattern of the first feed network 108 (FIG. 1) by about ninety degrees. In addition, respective microstrip connecting lines 115 and 116 of the illustrated first and second feed networks 108 and 110 coupling the networks 108 and 110 to respective ones of the antenna assemblies 104 are at least partially angled (e.g., at about thirty-five degree angles as measured relative to a direction of feed, travel, extension, etc. of the connecting lines 115 and 116 to/from the antenna assemblies 104, etc.) as they extend away from the antenna assemblies to help enable correct phasing of the components within the array antenna module 100. Moreover, this may help with positioning, fitting, etc. of the first and/or second feed networks 108 and/or 110 within the array antenna module 100 (e.g., where size constraints may be a concern, etc.) while still maintaining desired spacing from the antenna assemblies 104.

In other example embodiments, array antenna modules may include more than or fewer than sixteen antenna assemblies and/or antenna assemblies oriented differently across the array antenna modules than disclosed herein. For example, antenna assemblies may be generally oriented in two-by-two arrays, three-by-three arrays, two-by-eight arrays, four-by-three arrays, other size arrays, etc. within the scope of the present disclosure. In addition, array antenna modules may include feed networks having different network patterns and/or different angular orientations and/or connecting lines with different orientations than disclosed herein within the scope of the present disclosure. For example, at least one or more different corporate feed networks and/or series-fed networks may be used. In one example embodiment, for example, an array antenna module includes first and second feed networks wherein the first and second feed networks are generally similarly aligned but wherein the first feed network includes a first network pattern and the second feed network includes a second, different network pattern.

The illustrated array antenna module 100 also generally includes four spaced apart, stacked layers of substrates 118, 120, 122, and 124. First and second substrates 118 and 120 are located generally toward the upper portion of the array antenna module 100 (FIG. 1), and third and fourth substrates 122 and 124 are located generally toward the lower portion of the array antenna module 100 (FIG. 2). The substrates 118, 120, 122, and 124 are positioned generally parallel to each other. In addition, the first substrate 118 is positioned generally parallel to and generally above the second substrate 120, and the fourth substrate is positioned generally parallel to and generally below the third substrate 122. Further, the second substrate 120 is disposed generally between the first and third substrates 118 and 122, and the third substrate 122 is disposed generally between the second and fourth substrates 120 and 124.

A ground plane 128 is positioned generally parallel to and generally between the second and third substrates 120 and 122 (and generally separates the upper portion of the array antenna module 100 from the lower portion of the array antenna module 100). The ground plane 128 may include, for example, a metallic material (e.g., aluminum-plated steel, tin-plated steel, brass, etc.), etc. within the scope of the present disclosure. In FIG. 1, components of the array antenna module 100 disposed generally above the ground plane 128 but hidden by the first and/or second substrates 118 and/or 120 are shown in broken lines. And in FIG. 2, components of the array antenna module 100 disposed generally below the ground plane 128 but hidden by the third and/or fourth substrates 122 and/or 124 are shown in broken lines.

In the illustrated embodiment, the first substrate 118 includes a singled-sided printed circuit board (PCB) having circuitry (e.g., filters, oscillators, mixers, power amplifiers, etc.) for use in helping control operation of the array antenna module 100 (e.g., on an upper surface of the PCB, etc.). The second substrate 120 includes a double-sided PCB also having circuitry for use in helping control operation of the array antenna module 100 (e.g., on an upper and/or lower surface of the PCB, etc.). And the third substrate 122 includes a single-sided PCB having circuitry for use in helping control operation of the array antenna module 100 (e.g., on a lower surface of the PCB, etc.). The PCBs of the first, second, and/or third substrates 118, 120, and/or 122 may at least partially include epoxy resin bonded glass fabric (e.g., flame retardant 4 (FR4), etc.) in their constructions to help reduce product costs and to help improve operation thereof. In other example embodiments, PCBs may include other materials in their constructions, for example, low cost PCB construction materials, etc. In still other example embodiments, PCBs may include other substrate materials in their constructions, for example, polytetrafluoroethene (PTFE), etc.

The fourth substrate 124 includes a back plate (or support plate, etc.) for use in supporting the array antenna module 100 and/or coupling the array antenna module 100 to a network, system, etc. as desired. The back plate may include, for example, a metallic material, etc. within the scope of the present disclosure. The fourth substrate 124 may further provide a grounding surface behind the second feed network 110.

Figure 3:
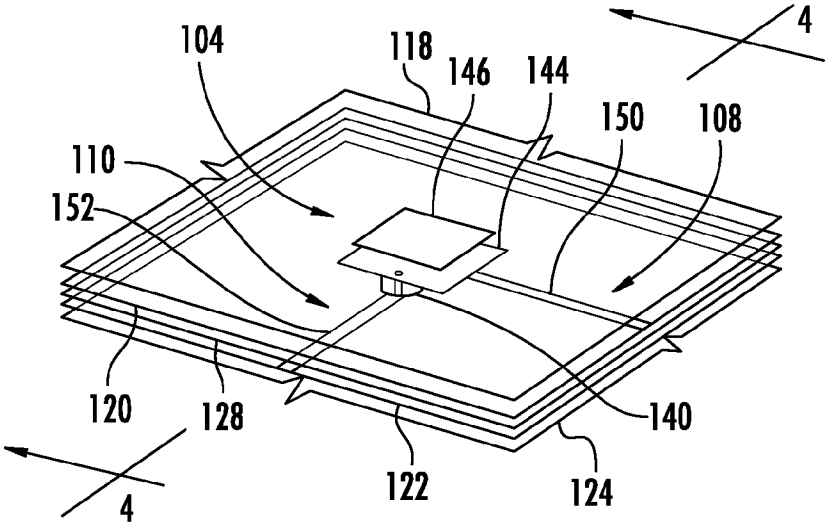
FIG. 3 is an enlarged fragmentary perspective view of an antenna assembly of the array antenna module of FIG. 1.
Figure 4:
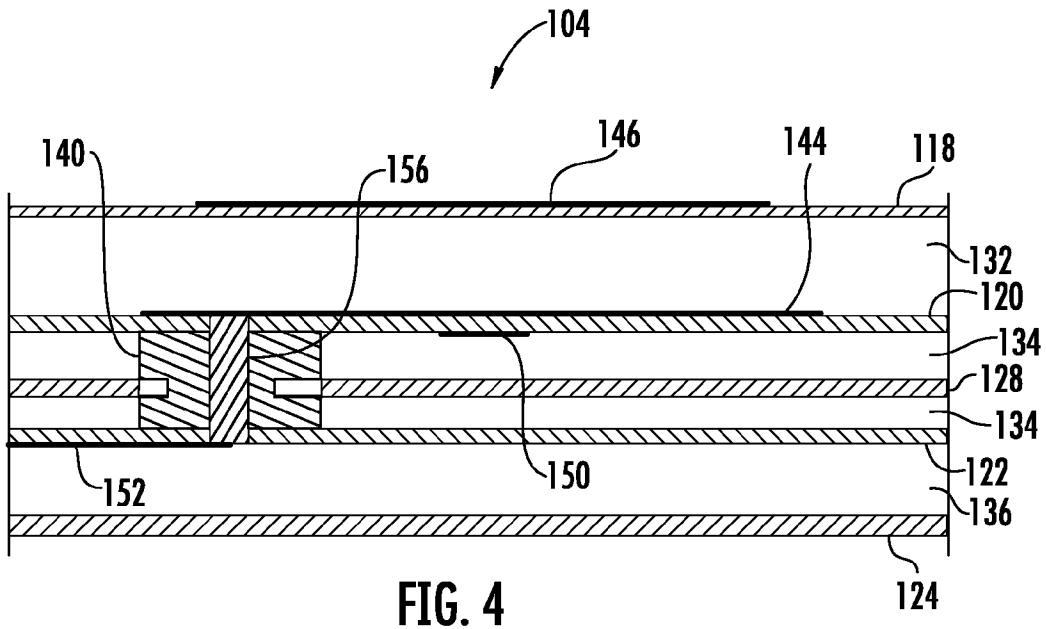
FIG. 4 is a section view of the antenna assembly of FIG. 3 taken in a plane including line 4-4 in FIG. 3.

With reference now to FIGS. 3 and 4, the first and second substrates 118 and 120, the second and third substrates 120 and 122, and the third and fourth substrates 122 and 124 are each separated by respective layers of air 132, 134, and 136. For example, spacers are positioned relative to adjacent ones of the substrates 118, 120, 122, and 124 to produce, provide, form, etc. each of the layers of air 132, 134, and 136. In the illustrated embodiment, for example, spacers (not shown) are positioned between the first and second substrates 118 and 120 to produce the layer of air 132 therebetween. And spacers (e.g., external spacers positioned outboard of the second feed network 110, etc.) are coupled to the fourth substrate 124 and the ground plane 128 to position the fourth substrate 124 relative to the third substrate 122 to produce the layer of air 136 between the third and fourth substrates 122 and 124. The spacers may include any suitable materials within the scope of the present disclosure, including, for example, foam, plastic materials, metallic materials, combinations thereof, etc.

Feed-point spacers 140 (only one is shown in FIGS. 3 and 4) are positioned between the second and third substrates 120 and 122 to produce the layer of air 134 therebetween. The feed-point spacers 140 extend generally through the ground plane 128 such that at least part of the air layer 134 produced between the second and third substrates 120 and 122 is located generally above the ground plane 128 and at least part of the air layer 134 is located generally below the ground plane 128. The feed-point spacers 140 may include any suitable materials within the scope of the present disclosure, including, for example, foam, plastic materials, metallic materials, combinations thereof, etc. And it should be appreciated that other suitable spacers may be used to produce the air layers 132, 134, and 136 in the array antenna module 100 within the scope of the present disclosure.

The antenna assemblies 104 of the illustrated array antenna module 100 will now be described. Each of the antenna assemblies 104 is substantially similar. Accordingly, the antenna assembly 104 illustrated in FIGS. 3 and 4 will be described with it understood that a description of each of the other antenna assemblies 104 of the illustrated array antenna module 100 is substantially the same.

The illustrated antenna assembly 104 generally includes a pair of patches, including a driven patch 144 (broadly, a radiating element) and a parasitic patch 146 (broadly, a radiating element). The driven patch 144 is coupled to (e.g., etched on, etc.) the second substrate 120 (e.g., to a PCB of the second substrate 120 in communication with circuitry of the PCB, etc.). And the parasitic patch 146 is coupled to (e.g., etched on, etc.) the first substrate 118 (e.g., to a PCB of the first substrate 118 in communication with circuitry of the PCB, etc.). Both the driven patch 144 and the parasitic patch 146 are positioned generally above the ground plane 128.

The parasitic patch 146 is spaced apart from (and separated from) the driven patch 144 generally by the air layer 132 between the first and second substrates 118 and 120. In this position, the parasitic patch 146 is capacitively coupled to the driven patch 144. In addition, the parasitic patch 146 is located generally above the driven patch 144 such that the patches 144 and 146 are positioned in a generally stacked orientation. Further, in the illustrated embodiment, the driven patch 144 is generally larger than the parasitic patch 146 such that the parasitic patch 146 is located generally above (e.g., stacked generally above, etc.) the driven patch 144 within a footprint defined by the driven patch 144. And the driven patch 144 and the parasitic patch 146 are both generally planar in shape and are further positioned in a generally parallel relative orientation.

With continued reference to FIGS. 3 and 4, the first and second feed networks 108 and 110 each include microstrip feed lines 150 and 152, respectively, coupled to the driven patch 144 (and generally to the antenna assembly 104 and parasitic patch 146) for use in receiving signals from and/or transmitting signals to the antenna assembly 104. As shown in FIG. 3, and as previously described in connection with the network patterns of the first and second feed networks 108 and 110, the microstrip feed line 150 of the first feed network is angularly offset from the microstrip feed line 152 of the second feed network 110 by about ninety degrees. This will be described in more detail hereinafter. As such, in FIG. 3, the microstrip feed line 150 of the first network 108 is shown extending generally toward the left of the driven patch 144, and the microstrip feed line 152 of the second feed network 110 is shown extending generally toward the right.

As shown in FIG. 4, the microstrip feed line 150 of the first feed network 108 is coupled to (e.g., etched on, etc.) the second substrate 120 (e.g., to a PCB of the second substrate 120 in communication with circuitry of the PCB, etc.). This microstrip feed line 150 is proximity coupled (e.g., capacitively coupled, etc.) to the antenna assembly 104 (e.g., to the driven patch 144 and/or parasitic patch 146 of the antenna assembly 104, etc.). And the microstrip feed line 152 of the second feed network 110 is coupled to (e.g., etched on, etc.) the third substrate 122 (e.g., to a PCB of the third substrate 122 in communication with circuitry of the PCB, etc.). This microstrip feed line 152 is separated from the driven patch 144 by the ground plane 128. A pin 156 (or probe, or other suitable connector, etc.) (and broadly, a connector) extends through the feed-point spacer 140 (and through at least part of the second substrate 120, the ground plane 128, and at least part of the third substrate 122) to directly (e.g., electrically, etc.) couple the microstrip feed line 152 to the antenna assembly 104 (e.g., to the driven patch 144 of the antenna assembly 104, etc.).

As previously stated, the illustrated array antenna module 100 may receive signals from and/or transmit signals to select systems, networks, devices, etc. as desired. For example, the first and second feed networks 108 and 110 can feed desired signals (e.g., via the first and second ports 112 and 114, etc.) to one or more of the antenna assemblies 104 disposed across the array antenna module 100 for transmission to at least one or more wireless application devices. In so doing, the first feed network 108 operates to capacitively feed the desired signals to the antenna assemblies 104 (e.g., to the driven patches 144 and/or the parasitic patches 146 of the antenna assemblies 104, etc.), and the second feed network 110 directly feeds the desired signals to the antenna assemblies 104 (e.g., to the driven patches 144 of the antenna assemblies 104, etc.) via the pins 156. The driven patch 144 is configured (e.g., sized, shaped, constructed, etc.) to provide, for example, one or more resonances at one or more desired bandwidths of frequencies (e.g., 4.9 GHz to 5.9 GHz, other desired bandwidths of frequencies, etc.). And the parasitic patch 146, which is capacitively coupled to the driven patch 144, is configured to introduce additional resonances at upper frequencies of the selected bandwidths, for example, to help improve the bandwidth at the upper frequencies. The coupling of the parasitic patch and the driven patch allows for additional bandwidth by exploiting the height of the parasitic patch (and the bandwidth that that it provides) in addition to the production of an additional resonance. The parasitic patch can thus help increase the bandwidth of the antenna assembly.

The illustrated array antenna module 100 includes antenna assemblies 104 having slant forty-five degree polarizations. And when used to transmit signals to at least one or more wireless application devices, the first feed network 108 operates to provide (e.g., feed, etc.) a first polarization of the desired signals to the antenna assemblies 104, and the second feed network 110 operates to provide (e.g., feed, etc.) a second polarization of the desired signals to the antenna assemblies 104. For example, the first and second polarizations of the desired signals may be shifted, offset, etc. +/−forty-five degrees (and a total of ninety degrees). The slant forty-five degree operation is based on the mounting of the array antenna module 100 such that one polarization is +45 degrees and the second polarization is −45 degrees, with the array antenna module 100 generally appearing as a diamond. In other example embodiments, array antenna modules may have other polarizations (e.g., other than slant forty-five degree polarizations, etc.) within the scope of the present disclosure.

Figure 5:
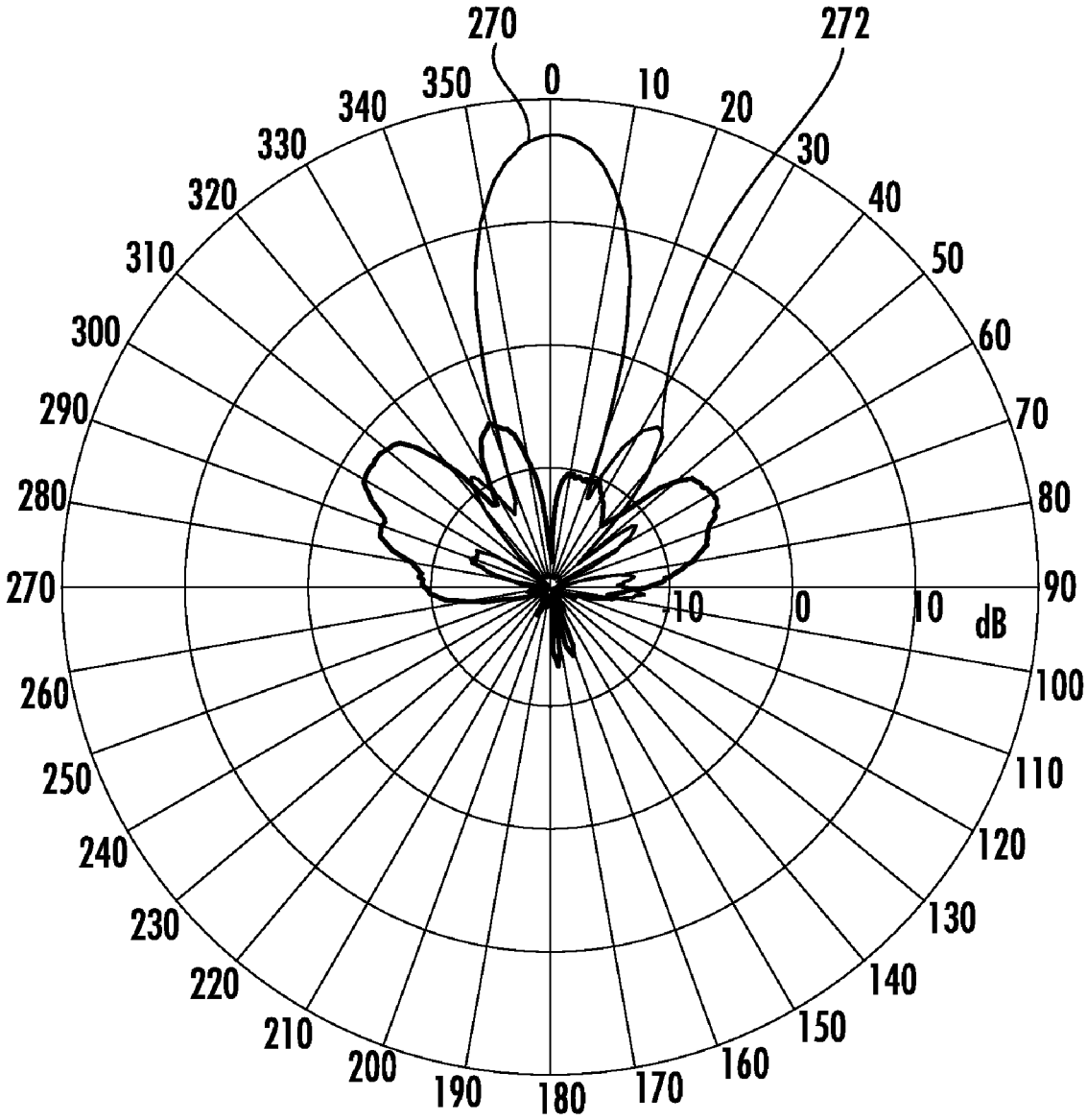
FIG. 5 illustrates co-polar and cross-polar E-plane (elevation) radiation patterns for the example array antenna module of FIG. 1 measured at a first port of the array antenna module at a frequency of about 5.47 Gigahertz (GHz)
Figure 6:
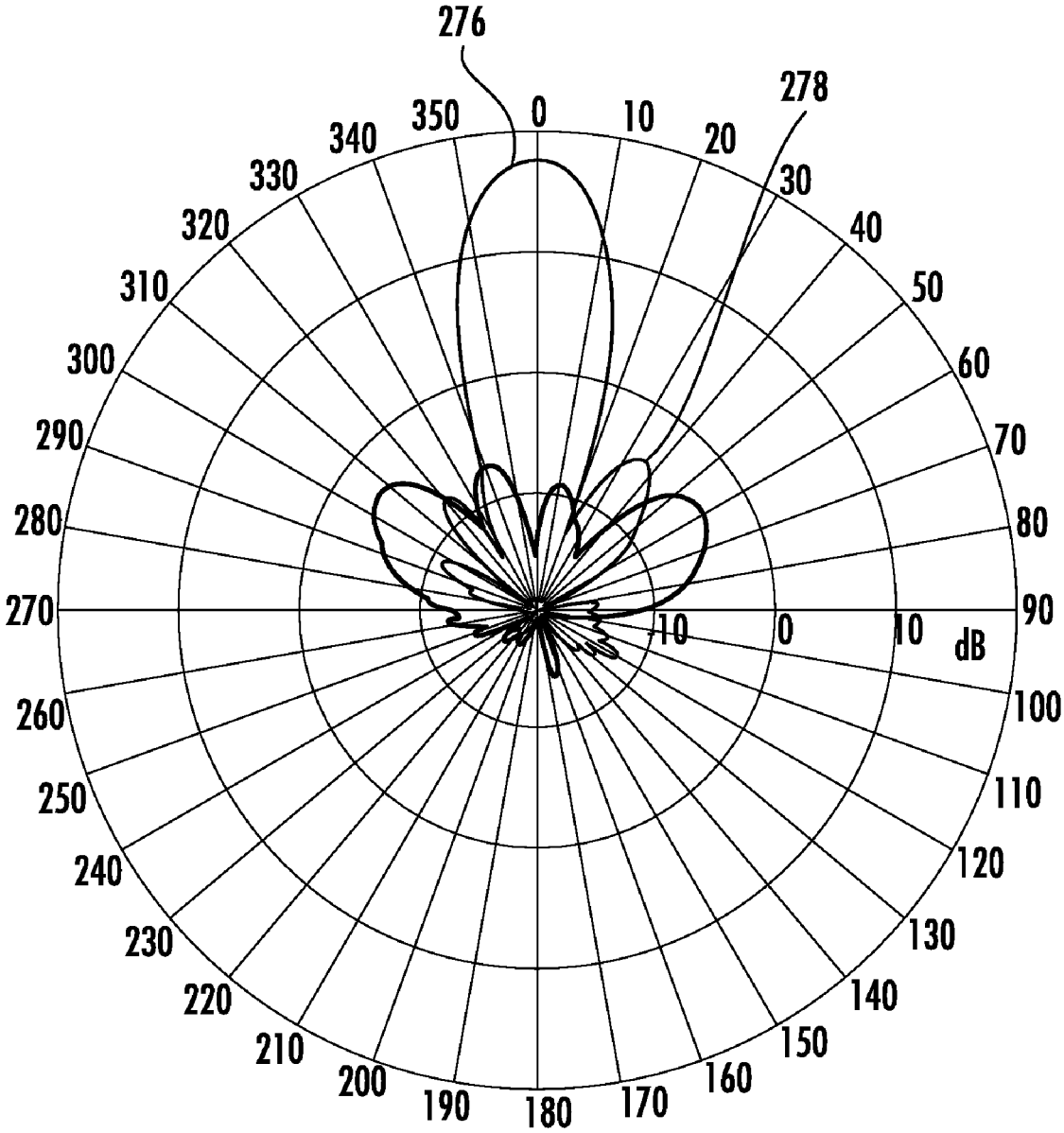
FIG. 6 illustrates co-polar and cross-polar H-plane (azimuth) radiation patterns for the example array antenna module of FIG. 1 measured at the first port of the array antenna module at a frequency of about 5.47 GHz.

With reference now to FIGS. 5-8, example measured radiation patterns (e.g., slant forty-five degree radiation patterns, etc.) for gain are shown for an example array antenna module substantially similar to the array antenna module described above and illustrated in FIGS. 1-4 (and, for example, mounted in a diamond configuration when the slant forty-five degree radiation patterns were measured, etc.). For example, FIG. 5 illustrates example co-polar and cross-polar measured E-plane (elevation) radiation patterns 270 and 272, respectively, for gain at a first port of the example array antenna module at a frequency of about 5.47 Gigahertz (GHz). FIG. 6 illustrates example co-polar and cross-polar measured H-plane (azimuth) radiation patterns 276 and 278, respectively, for gain at the first port of the example array antenna module at a frequency of about 5.47 GHz. FIG. 7 illustrates example co-polar and cross-polar measured E-plane (elevation) radiation patterns 282 and 284, respectively, for gain at a second port of the example array antenna module at a frequency of about 5.47 GHz. And FIG. 8 illustrates example co-polar and cross-polar measured H-plane (azimuth) radiation patterns 288 and 290, respectively, for gain at the second port of the array antenna module at a frequency of about 5.47 GHz.

The illustrated radiation patterns generally indicate that the example array antenna module exhibits, at the least, relatively low side lobe values (e.g., relatively low interference with unintended receivers, etc.), generally good front-to-back ratio, and relatively low cross-polarization (e.g., low interaction with opposite polarizations, etc.). And overall, the example array antenna module exhibits good performance.

In one example embodiment of the present disclosure, an array antenna module is operable over a bandwidth of frequencies between about 4.9 GHz and about 5.9 GHz. The example array antenna module includes sixteen slant forty-five degree antenna assemblies disposed generally over the array antenna module. And the array antenna module includes a length dimension of about 200 millimeters (mm), a width dimension of about 200 mm, and a thickness dimension of about 11 mm. In operation, the example array antenna module exhibits a gain of about 17 decibels isotropic (dBi), a cross-polarization of about 15 dB, a port-to-port isolation of about 20 dB, and a voltage standing wave ratio (VSWR) of about 2.0:1. And azimuth and elevation beam widths of the example array antenna module are each about 15 degrees nominal. Overall, the example array antenna module of this embodiment exhibits good performance.

In other example embodiments, array antenna modules may include at least one or more antenna assemblies having two or more parasitic patches together with a driven patch. The additional parasitic patches may operate to further increase bandwidth of the at least one or more antenna assemblies.

It should be appreciated that example array antenna modules disclosed herein may be suitable for operating at one or more different bandwidths of frequencies, including, for example, 500-700 megahertz (MHz), 2.1-2.7 GHz, 3.3-3.8 GHz, 4.9-5.9 GHz, etc. However, the bandwidths of frequencies included herein should not be considered limiting as example array antenna modules may be suitable for operating at one more other bandwidths of frequencies within the scope of the present disclosure.

It should also be appreciated that array antenna modules disclosed herein include angularly offset feed networks and/or angled connecting lines that may help improve gain in the array antenna module and/or that may help isolate the feed networks and help reduce, inhibit, etc. interference. For example, the feed networks may be angularly offset about ninety-degrees, etc., and connecting lines may be at least partially relatively angled to form, for example, about thirty-five degree angles, etc. (e.g., to help position feed networks within space constrained areas of array antenna modules, etc.). In addition, the array antenna modules include slant forty-five degree antenna assemblies that may help improve gain for the modules. These feed networks (e.g., their orientations, constructions, network patterns, etc.) may allow for materials other than traditional microwave laminates to be used for substrates of the array antenna modules, such as, for example, epoxy resin bonded glass fabric materials (e.g., flame retardant 4 (FR4), etc.), etc.

In addition, array antenna modules of the present disclosure may include PCBs comprising epoxy resin bonded glass fabric materials (e.g., flame retardant 4 (FR4), etc.). Use of these materials may provide enhanced performance as well as reduced cost as compared to using PCBs comprising traditional microwave laminates.

Numerical dimensions, values, and specific materials are provided herein for illustrative purposes only. The particular dimensions, values and specific materials provided herein are not intended to limit the scope of the present disclosure.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An antenna assembly configured for use with at least one or more wireless application devices, the antenna assembly comprising:

a first radiating element;

a second radiating element spaced apart from the first radiating element and capacitively coupled to the first radiating element;

a first transmission line capacitively coupled to the first radiating element;

a second transmission line; and a connector electrically coupling the second transmission line and the first radiating element;

whereby the antenna assembly is operable to transmit at least one or more signals to at least one or more wireless application devices and/or to receive at least one or more signals from at least one or more wireless application devices.

2. The antenna assembly of claim 1, wherein the first and second radiating elements are positioned in a generally stacked orientation.

3. The antenna assembly of claim 2, wherein the second radiating element is positioned within a footprint defined by the first radiating element.

4. The antenna assembly of claim 2, wherein the first and second radiating elements are both generally planar in shape and are further positioned in a generally parallel orientation.

5. The antenna assembly of claim 2, wherein the first and second radiating elements are separated by a layer of air.

6. The antenna assembly of claim 2, wherein the first radiating element includes a driven patch.

7. The antenna assembly of claim 6, wherein the second radiating element includes a parasitic patch.

8. The antenna assembly of claim 2, wherein the connector includes a pin electrically coupling the second transmission line to the first radiating element.

9. The antenna assembly of claim 2, wherein the first transmission line is at least partially positioned within a first plane and the second transmission line is at least partially positioned within a second plane oriented generally parallel to the first plane, the first transmission line being angularly offset from the second transmission line by about ninety degrees.

10. The antenna assembly of claim 2, wherein the first radiating element and the second transmission line are at least partially separated by a ground plane, the connector extending through the ground plane for electrically coupling the second transmission line to the first radiating element.

11. The antenna assembly of claim 1, wherein the first transmission line includes a feed line for feeding a signal to the antenna assembly at a first polarization for transmission to at least one or more wireless application devices, and wherein the second transmission line includes a feed line for feeding the signal to the antenna assembly at a second polarization for transmission to the at least one or more wireless application devices.

12. The antenna assembly of claim 1, wherein the antenna assembly includes a slant forty-five degree antenna assembly.

13. The antenna assembly of claim 1, wherein the first radiating element is coupled to a substrate, the second radiating element is coupled to a substrate, the first transmission line is coupled to a substrate, and the second transmission line is coupled to a substrate, and wherein at least one or more of the substrates includes epoxy resin bonded glass fabric.

14. The antenna assembly of claim 13, wherein the epoxy resin bonded glass fabric includes flame retardant 4.

15. The antenna assembly of claim 13, wherein the first radiating element and the first transmission line are coupled to the same substrate.

16. An array antenna module comprising the antenna assembly of claim 1.

17. An array antenna module comprising at least two or more of the antenna assemblies of claim 1.

18. The array antenna module of claim 17, comprising sixteen of the antenna assemblies.

19. The array antenna module of claim 17, comprising a four-by-four array of the antenna assemblies.

20. A network including at least one or more of the antenna assemblies of claim 1.

21. An array antenna module having an array of antenna assemblies, each antenna assembly comprising:

a first radiating element;

a second radiating element spaced apart from the first radiating element and capacitively coupled to the first radiating element;

a first transmission line capacitively coupled to the first radiating element;

a second transmission line; and a connector electrically coupling the second transmission line and the first radiating element.

22. The array antenna module of claim 21, wherein the first and second radiating elements are positioned in a generally stacked orientation.

23. The array antenna module of claim 22, wherein the first radiating element includes a driven patch and the second radiating element includes a parasitic patch.

24. The array antenna module of claim 21, wherein the first radiating element is coupled to a substrate, the second radiating element is coupled to a substrate, the first transmission line is coupled to a substrate, and the second transmission line is coupled to a substrate, and wherein at least one or more of the substrates includes epoxy resin bonded glass fabric.

25. The antenna assembly of claim 24, wherein the epoxy resin bonded glass fabric includes flame retardant 4.

26. The array antenna module of claim 21, wherein the first transmission line is operable for feeding a signal to the antenna assembly at a first polarization, and the second transmission line is operable for feeding the signal to the antenna assembly at a second polarization.

27. The array antenna module of claim 21, comprising a four-by-four array of antenna assemblies.

28. A network including the array antenna module of claim 21.

29. An array antenna module comprising:

first, second, and third spaced apart substrates, the first, second, and third substrates being positioned in a generally stacked orientation such that the second substrate is disposed generally between the first and third substrates, at least one or more of the first, second, and third substrates including epoxy resin bonded glass fabric;

multiple first and second pairs of radiating elements, a first radiating element of each pair being coupled to the second substrate and a second radiating element of each pair being coupled to the first substrate in a stacked orientation relative to the first radiating element of its pair; and first and second transmission line networks interconnecting each of the multiple first and second pairs of radiating elements for use in feeding at least one or more signals to the multiple first and second pairs of radiating elements, the first transmission line network being operable for feeding the at least one or more signals to the multiple first and second pairs of radiating elements at a first polarization, and the second transmission line network being operable for feeding the at least one or more signals to the multiple first and second pairs of radiating elements at a second polarization.

30. The array antenna module of claim 29, wherein the first, second, and third substrates each include epoxy resin bonded glass fabric.

31. The array antenna module of claim 29, wherein the epoxy resin bonded glass fabric includes flame retardant 4.

32. The array antenna module of claim 29, wherein the first substrate includes a single-sided printed circuit board, the second radiating element of each pair of first and second radiating elements being etched on an upper surface of the printed circuit board.

33. The array antenna module of claim 32, wherein the second radiating element of each pair of first and second radiating elements includes a parasitic patch.

34. The array antenna module of claim 29, wherein the second substrate includes a doubled-sided printed circuit board, the first radiating element of each pair of first and second radiating elements being etched on an upper surface of the printed circuit board.

35. The array antenna module of claim 34, wherein the first radiating element of each pair of first and second radiating elements includes a driven patch.

36. The array antenna module of claim 34, wherein the first transmission line network is etched on a lower surface of the printed circuit board of the second substrate.

37. The array antenna module of claim 36, wherein the first transmission line network is capacitively coupled to each pair of first and second radiating elements.

38. The array antenna module of claim 29, wherein the third substrate includes a single-sided printed circuit board, the second transmission line network being etched on a lower surface of the printed circuit board.

39. The array antenna module of claim 38, further comprising multiple electrical connectors, wherein the second transmission line network is electrically coupled to the first radiating element of each pair of first and second radiating elements by one of the multiple electrical connectors.

40. The array antenna module of claim 39, wherein the second substrate includes a doubled-sided printed circuit board, the first radiating element of each pair of first and second radiating elements being etched on an upper surface of said printed circuit board.

41. The array antenna module of claim 40, further comprising a ground plane disposed generally between the second and third substrates, each electrical connector extending through at least part of the third substrate, through the ground plane, and through at least part of the second substrate to electrically couple the second transmission line interwork to the first radiating element of each pair of first and second radiating elements.

42. The array antenna module of claim 39, wherein the first and second substrates are separated by a layer of air, and wherein the second and third substrates are separated by a layer of air.

43. The array antenna module of claim 29, further comprising a back plate positioned in a generally stacked orientation with the first, second, and third substrates, the third substrate being disposed generally between the second substrate and the back plate, the third substrate and the back plate being separated by a layer of air.

44. The array antenna module of claim 29, comprising sixteen pairs of first and second radiating elements.

45. The array antenna module of claim 29, wherein the first transmission line network and the second transmission line network are each positioned within generally parallel planes, the first and second transmission line networks each defining substantially similar network patterns angularly offset by about ninety degrees.

46. The array antenna module of claim 29, wherein the first and second transmission line networks include connecting lines coupling the networks to respective pairs of radiating elements, at least one or more of the connecting lines defining an angle of about thirty-five degrees as it extends away from a respective pair of radiating elements.

47. A network including the array antenna module of claim 29.

48. An array antenna module comprising:

first, second, and third spaced apart printed circuit boards positioned in a generally stacked orientation such that the second printed circuit board is disposed generally between the first and third printed circuit boards, at least one or more of the first, second, and third printed circuit boards including epoxy resin bonded glass fabric;

multiple pairs of driven and parasitic patches, a driven patch of each pair being etched on an upper surface of the second printed circuit board, and a parasitic patch of each pair being etched on an upper surface of the first printed circuit board in a stacked orientation relative to its paired driven patch;

first and second transmission line networks interconnecting each of the multiple pairs of driven and parasitic patches for feeding at least one or more signals to the multiple pairs of driven and parasitic patches for transmission to at least one or more wireless application devices, the first transmission line network being etched on a lower surface of the second printed circuit board and the second transmission line network being etched on a lower surface of the third printed circuit board, the first transmission line network being capacitively coupled to each pair of driven and parasitic patches; and multiple electrical connectors connecting the second transmission line network to each driven patch of each pair of driven and parasitic patches;

whereby the first transmission line network is operable for feeding the at least one or more signals to the multiple pairs of driven and parasitic patches at a first polarization, and the second transmission line network is operable for feeding the at least one or more signals to the multiple pairs of driven and parasitic patches at a second polarization.

49. The array antenna module of claim 48, wherein the epoxy resin bonded glass fabric includes flame retardant 4.

50. The array antenna module of claim 49, wherein each of the first, second, and third printed circuit boards includes flame retardant 4.

* * * * *